US010953968B2

(12) United States Patent
Gundersen et al.

(10) Patent No.: US 10,953,968 B2
(45) Date of Patent: Mar. 23, 2021

(54) CONTROL OF PROPELLER SHAFT MOVEMENT

(71) Applicant: ABB Schweiz AG, Baden (CH)

(72) Inventors: Børre Gundersen, Oslo (NO); Frank Wendt, Oslo (NO); Jaroslaw Nowak, Oslo (NO); Matko Barisic, Oslo (NO)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/313,701

(22) PCT Filed: Jun. 7, 2017

(86) PCT No.: PCT/EP2017/063751
§ 371 (c)(1),
(2) Date: Dec. 27, 2018

(87) PCT Pub. No.: WO2018/001685
PCT Pub. Date: Jan. 4, 2018

(65) Prior Publication Data

US 2019/0263492 A1 Aug. 29, 2019

(30) Foreign Application Priority Data

Jun. 28, 2016 (EP) ..... 16176574

(51) Int. Cl.
*B63H 1/15* (2006.01)
*B63H 1/28* (2006.01)
(Continued)

(52) U.S. Cl.
CPC ..... *B63H 1/15* (2013.01); *B63H 1/28* (2013.01); *B63H 21/21* (2013.01); *B63H 23/35* (2013.01); *B63H 2021/216* (2013.01)

(58) Field of Classification Search
CPC . B63H 1/15; B63H 1/28; B63H 21/21; B63H 2021/216; B63H 23/35; B63H 23/25
See application file for complete search history.

(56) References Cited

U.S. PATENT DOCUMENTS 2,320,721 A 6/1943 Nils Ericson
6,752,670 B2 6/2004 Geil
(Continued)

FOREIGN PATENT DOCUMENTS

CN 104093628 A 10/2014
CN 104136317 A 11/2014
(Continued)

OTHER PUBLICATIONS

Korean Office Action Translation Application No. 10-2019-7002257 Completed: Oct. 7, 2019 5 Pages.
(Continued)

*Primary Examiner* — Stephen P Avila
(74) *Attorney, Agent, or Firm* — Whitmyer IP Group LLC

(57) ABSTRACT

There is provided mechanisms for controlling movement of a propeller shaft on a vessel. A controller includes processing circuitry. The processing circuitry is configured to cause the controller to detect movement of the propeller shaft by determining a signature of a sustained oscillation of the propeller shaft. The processing circuitry is configured to cause the controller to control movement of the propeller shaft according to the determined signature.

21 Claims, 6 Drawing Sheets

(51) Int. Cl.
*B63H 21/21* (2006.01)
*B63H 23/35* (2006.01)

(56) References Cited

U.S. PATENT DOCUMENTS

| | | | | |
|---|---|---|---|---|
| 10,228,304 | B2 * | 3/2019 | Heyerman | G01M 13/028 |
| 2013/0205389 | A1 * | 8/2013 | Grocutt | G06F 21/52 726/22 |
| 2014/0364019 | A1 | 12/2014 | Ito et al. | |
| 2015/0370266 | A1 | 12/2015 | Norris et al. | |

FOREIGN PATENT DOCUMENTS

| | | | |
|---|---|---|---|
| EP | 1470463 | A1 | 10/2004 |
| EP | 2634084 | A1 | 9/2013 |
| GB | 2155880 | A | 10/1985 |
| JP | 103149431 | A | 6/1991 |
| JP | 2013163438 | A | 8/2013 |
| JP | 2015508734 | A | 3/2015 |
| KR | 20140129294 | A | 11/2014 |
| RU | 2009957 | C1 | 3/1994 |
| WO | 0047464 | A1 | 8/2000 |
| WO | 2008155448 | A1 | 12/2008 |

OTHER PUBLICATIONS

European Search Report Application No. EP 16 17 6574 Completed: Dec. 2, 2016; dated Dec. 13, 2016 8 pages.
International Preliminary Report on Patentability Application No. PCT/EP2017/063751 Completed: Sep. 7, 2018; dated Sep. 7, 2018 9 pages.
International Search Report and Written Opinion of the International Searching Authority Application No. PCT/EP2017/063751 Completed: Sep. 1, 2017; dated Sep. 7, 2017 13 pages.
Written Opinion of the International Searching Authority Application No. PCT/EP2017/063751 dated May 18, 2018 7 pages.
Korean Office Action and Translation Application No. 10-2019-7002257 dated Apr. 27, 2020 12 pages.
Singapore Office Action Application No. 11201811464X dated Apr. 21, 2020 4 pages.
Chinese Search Report Application No. 2017800402393; dated May 26, 2020; 19 pages.

* cited by examiner

CONTROL OF PROPELLER SHAFT MOVEMENT

TECHNICAL FIELD

Embodiments presented herein relate to a method, an arrangement, a controller, a computer program, and a computer program product for controlling movement of a propeller shaft.

BACKGROUND

Long sea shipping ships relying on electrical propulsion, such as LNG carriers, are characterized by optimized engineering designs that strive to achieve as high an operating efficiency per tonne of fuel, as possible. This design problem encompasses the entire propulsion power generation, transfer, conversion, and delivery, i.e. the entire drive-train of the vessel, terminating ultimately in the end-effector of naval propulsion, the propeller. Traditionally, the philosophy of design of the mechanical part of the drive-train consisting of the shaft, bearings, clutches if present, gearboxes if present, and the propeller has been extensively studied, and is both quite conservative, and considered separately from the design of the electrical part. The propeller especially, with highly non linear hydrodynamics involved in calculation of effects, efficiency, wear-and-tear, and criticality, is often designed from experience. Procedures, design, and build are as a rule grounded in experimental know-how expressed as various design diagrams and curves from scale or true form factor measurements. If cyclic design is present, it is a relatively slow, experiment-driven cycle of prototyping, scaling down, and testing against scale models of vessels and propellers, in testing tanks.

Propellers are designed primarily with respect to two opposed design criteria. The first is propulsion efficiency, i.e. the rate of transfer of energy from the rotational kinetic energy of the propeller assembly, hub, and blades, to the kinetic energy of the entrained water flow. This resultant kinetic energy is what causes the reactive acceleration of the ship and thereby its motion on its course and steering of its heading and course. The other design criterion is avoidance of several critical behaviors, one of which is cavitation. Cavitation is a nonlinear phase-change hydrodynamic phenomenon introducing a wholly new energy flow in the diagram of energy transfer from the rotational kinetic energy to the kinetic energy of the entrained fluid. This parasitic flow is induced by introducing an avenue for the escape of energy as, first, thermal energy of the produced cavitation bubbles, followed by release of mechanical energy of bubble implosion, useless from the point of view of propulsion of the vessel, which is expended on physically eroding the propeller blades.

Consequently, in traditional electrical propulsion shipbuilding of long sea shipping vessels, designers and engineers of the electrical part of the propulsion system are presented with the design envelopes and performance indices of the mechanical part as-is. A variety of parameters of one or more algorithms that steer, control, supervise, and govern the rate of generation, transfer, and conversion of electrical power, are then engineered in order to adapt to, obey, be consistent, and compatible with the presented design envelopes, chief among them those of the end-effector—the propeller.

However, there is still a need for an improved control of the propeller.

SUMMARY

An object of embodiments herein is to provide efficient and robust control of a propeller of a vessel.

According to a first aspect there is presented a controller for controlling movement of a propeller shaft on a vessel. The controller comprises processing circuitry. The processing circuitry is configured to cause the controller to detect movement of the propeller shaft by determining a signature of a sustained oscillation of the propeller shaft. The processing circuitry is configured to cause the controller to control movement of the propeller shaft according to the determined signature.

According to a second aspect there is presented an arrangement for controlling movement of a propeller shaft on a vessel. The arrangement comprises a controller according to the first aspect. The arrangement comprises a vibration sensor configured to provide a signal indicative of the sustained oscillation to the controller. The controller comprises a propulsion control unit configured to control movement of the propeller shaft according to the determined signature.

According to a third aspect there is presented a method for controlling movement of a propeller shaft on a vessel. The method comprises detecting movement of the propeller shaft by determining a signature of a sustained oscillation of the propeller shaft. The method comprises controlling movement of the propeller shaft according to the determined signature.

According to a fourth aspect there is presented a computer program for controlling movement of a propeller shaft on a vessel, the computer program comprising computer program code which, when run on a controller, causes the controller to perform a method according to the third aspect.

According to a fifth aspect there is presented a computer program product comprising a computer program according to the fourth aspect and a computer readable storage medium on which the computer program is stored. The computer readable storage medium could be a non-transitory computer readable storage medium.

Advantageously this arrangement, this controller, this method and this computer program provide efficient control of the movement of the propeller shaft on a vessel.

Advantageously this arrangement, this controller, this method and this computer program enable to correctly detect adverse operating conditions on the mechanical assembly of the drive-train of the vessel in a reliable, computationally well behaved way.

Advantageously this arrangement, this controller, this method and this computer program enable to correctly identify the degree to which the detected adverse operating conditions on a propeller are caused by cavitation in a reliable, computationally well behaved way.

Advantageously this arrangement, this controller, this method and this computer program provide an overall increase of the total conversion of tonne of fuel to mechanical propulsion power (i.e., power used for accelerating the vessel on course or rotating the vessel about the yaw axis) of 3-4% conservatively, in the large (over the course of the vessel's lifecycle).

It is to be noted that any feature of the first, second, third, fourth, and fifth aspects may be applied to any other aspect, wherever appropriate. Likewise, any advantage of the first aspect may equally apply to the second, third, fourth, and/or fifth aspect, respectively, and vice versa. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The inventive concept is now described, by way of example, with reference to the accompanying drawings, in which.

DETAILED DESCRIPTION

The inventive concept will now be described more fully hereinafter with reference to the accompanying drawings, in which certain embodiments of the inventive concept are shown. This inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description. Any step or feature illustrated by dashed lines should be regarded as optional.

Figure 1:
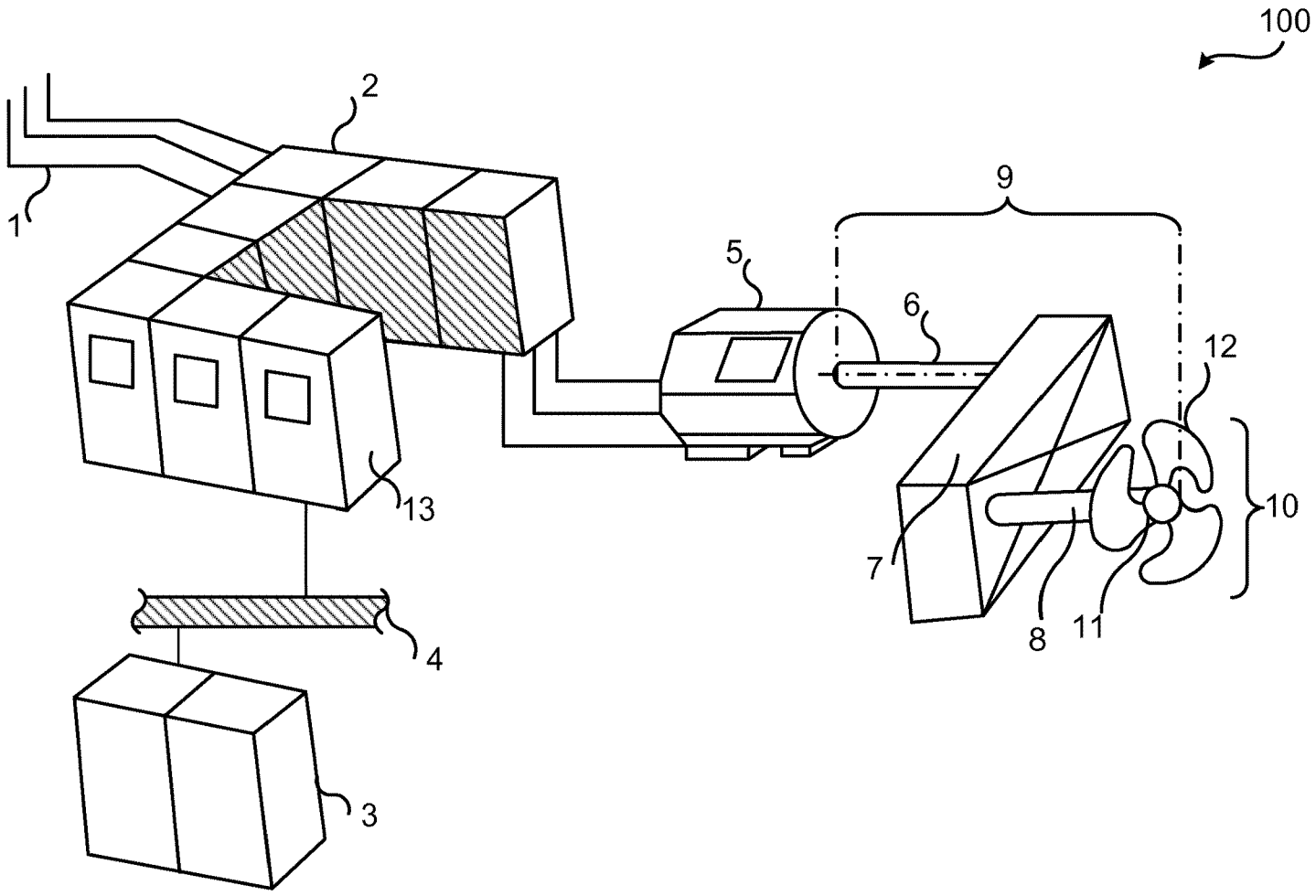
FIGS. 1 and 2 are schematic diagrams illustrating arrangements according to embodiments.

An arrangement 100 for controlling movement of a propeller shaft on a vessel is schematically illustrated in FIG. 1. According to an embodiment the vessel is an electrical propulsion vessel. The vessel could be an ice breaker. The arrangement comprises a plurality of upstream connections to an electrical power infrastructure 1, which may or may not include transformers, transducers, protective and safety devices, disconnectors, circuit breakers, or fuses. The electrical power infrastructure 1 supplies a drive subsystem 2 of an electrical motor 5. The electrical motor 5 converts the supplied electrical power into mechanical torque on its takeout shaft 6, which may be connected by a plurality of mechanical, hydraulic, or pneumatic linkages, or linkages comprising a combination of subsystems 7 of anyone of the mentioned natures including but not limited to gearboxes, clutches, bearings etc., to the propeller shaft 8. The propeller shaft 8 is the last, mechanically rigidly connected shaft of a mechanical linkage subsystem 9 connected to the propeller 10 and comprises a hub 11 and blades 12. The entire assembly consisting of the electrical motor 5, the takeout shaft 6, the linkage(s) 7, the propeller shaft 8, and the propeller itself 10 may in a particular embodiment be mounted inside an integral pod, as illustrated in FIG. 2 (see below).

The electromotor drive 2 furthermore comprises an internal processing/regulation/governing unit 13, connected to a propulsion control unit 3. The connection is achieved via a plurality of electrical, optical, magnetic, or electromagnetically radiated wireless field-bus communication architectures/stacks 4, or field-buses comprising a combination of these media. Alternatively, the same connection can be achieved by a plurality of electrical, optical, magnetic, or electromagnetically radiated wireless hardwired communication lines, or a combination of the two (e.g., a field-bus stack and hardwired line or lines).

Figure 2:
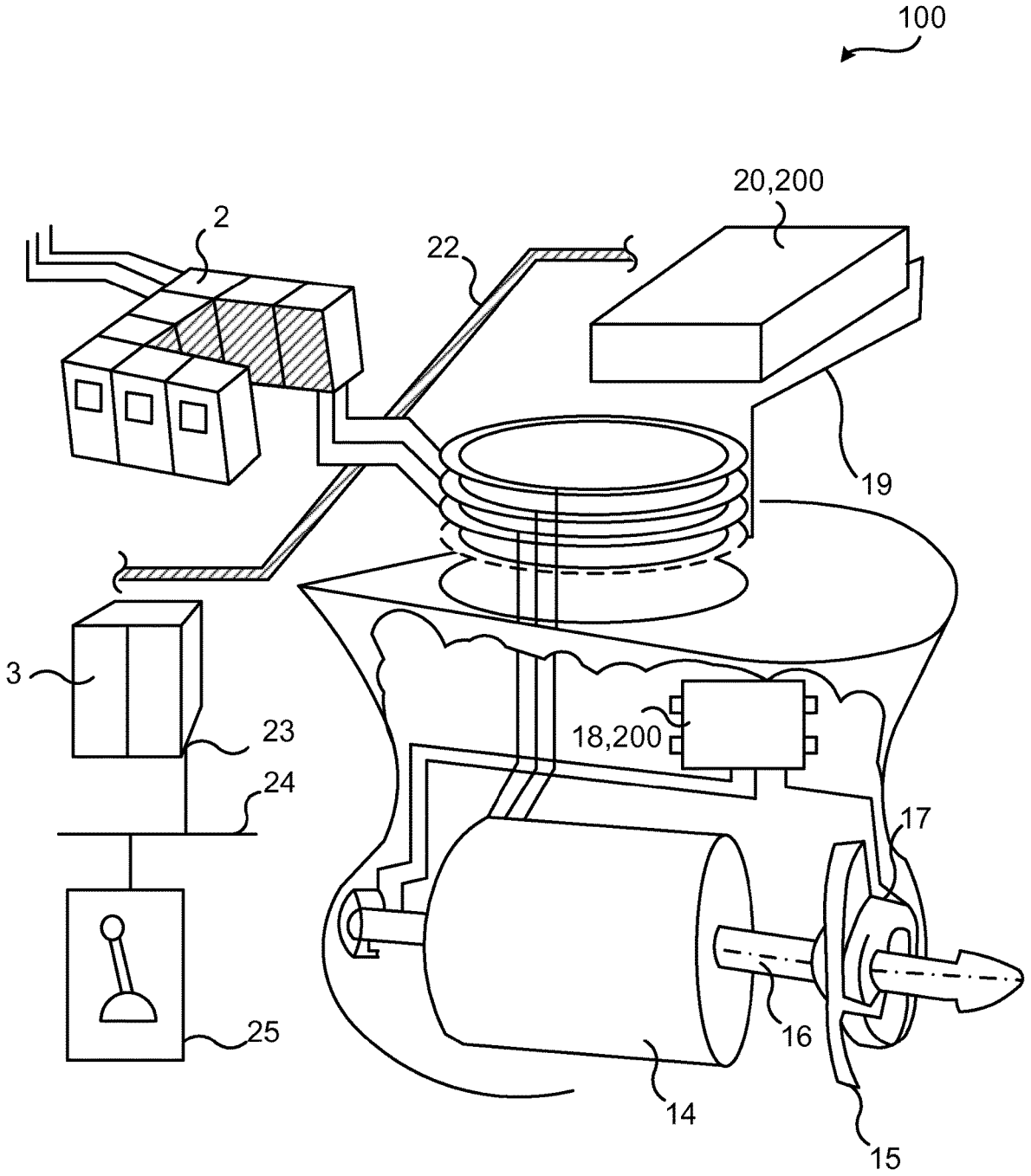

Reference is now further made to FIG. 2 schematically illustrating further aspects of the arrangement 100. In the schematic illustration of FIG. 2 electromotor 14 housing, structural supports, frame, mounting points, as well as the elements and subsystems of the mechanical linkage between the housing, the takeout shaft, and the propeller shaft, in some embodiments most notably bearings 15 and the takeout/propeller shaft 16, are equipped with a plurality of physical sensors 17. In some embodiments these physical sensors measure one or more of linear accelerations, angular speeds of rotation, angular accelerations, or angular positions (in terms of encoded shaft positions on an encoder or some other means), tensions, torsions, material stresses, or forces of the propeller shaft.

The arrangement may further comprise a dedicated measurement collection, logging, collation, filtering, or estimation unit 18 configured to collect, log, collate, filter, and/or estimate an ensemble of measurement by receiving one, more than one, or all of the measurements of the physical sensors 17. This unit 18, if present, is configured to communicate by using a plurality of electrical, optical, magnetic, or electromagnetically radiated wireless field-bus communication architectures/stacks 19, or field-buses that comprise a combination of these media, its collected, logged, collated, filtered, or estimated measurement ensemble to a rapid signal processing and machine knowledge unit 20. Alternatively, the functions of the measurement collection, logging, collation, filtering, or estimation unit 18 and of the rapid signal processing and machine knowledge unit 20 may be combined into, or be part of, a single unit, such as a controller 200.

The rapid signal processing and machine knowledge unit 20 is configured to communicate with the propulsion control unit 3 by a plurality of electrical, optical, magnetic, or electromagnetically radiated wireless field-bus communication architectures/stacks 22, or field-buses comprise of a combination of these media. Alternatively, the rapid signal processing and machine knowledge unit 20 may be realized on top of the propulsion control unit 3, such that functions of units 3 and 20 are thus consolidated in unit 3, the dedicated measurement collection, logging, collation, filtering, or estimation unit 18 exists separately. Unit 18 is in such a configuration connected, in the previously described fashion, to such a consolidated propulsion control unit 3. As a further alternative, if a dedicated measurement unit 18 is not provided, yet its functions are consolidated with those of the propulsion control unit 3, the measurement elements 17 are connected, in a previously described fashion, directly to the propulsion control unit 3. The latter may then also include the functionality of the rapid signal processing and machine knowledge unit 20, amounting to a total consolidation, and unique embodiment of units 3, 18, and 20, or continue to rely on a separately embodied unit 20.

Furthermore, the propulsion control unit 3 has an input 23, provided by a plurality of electrical, optical, magnetic, or electromagnetically radiated wireless field-bus communication architectures/stacks 24, or field-buses comprising a combination of these media, or alternatively hard wired directly, to some reference-giving functional unit 25. This functional unit 25 provides an absolute or relative (scaled) reference for the power to be commanded to the electromotor drive 2.

Figure 3:
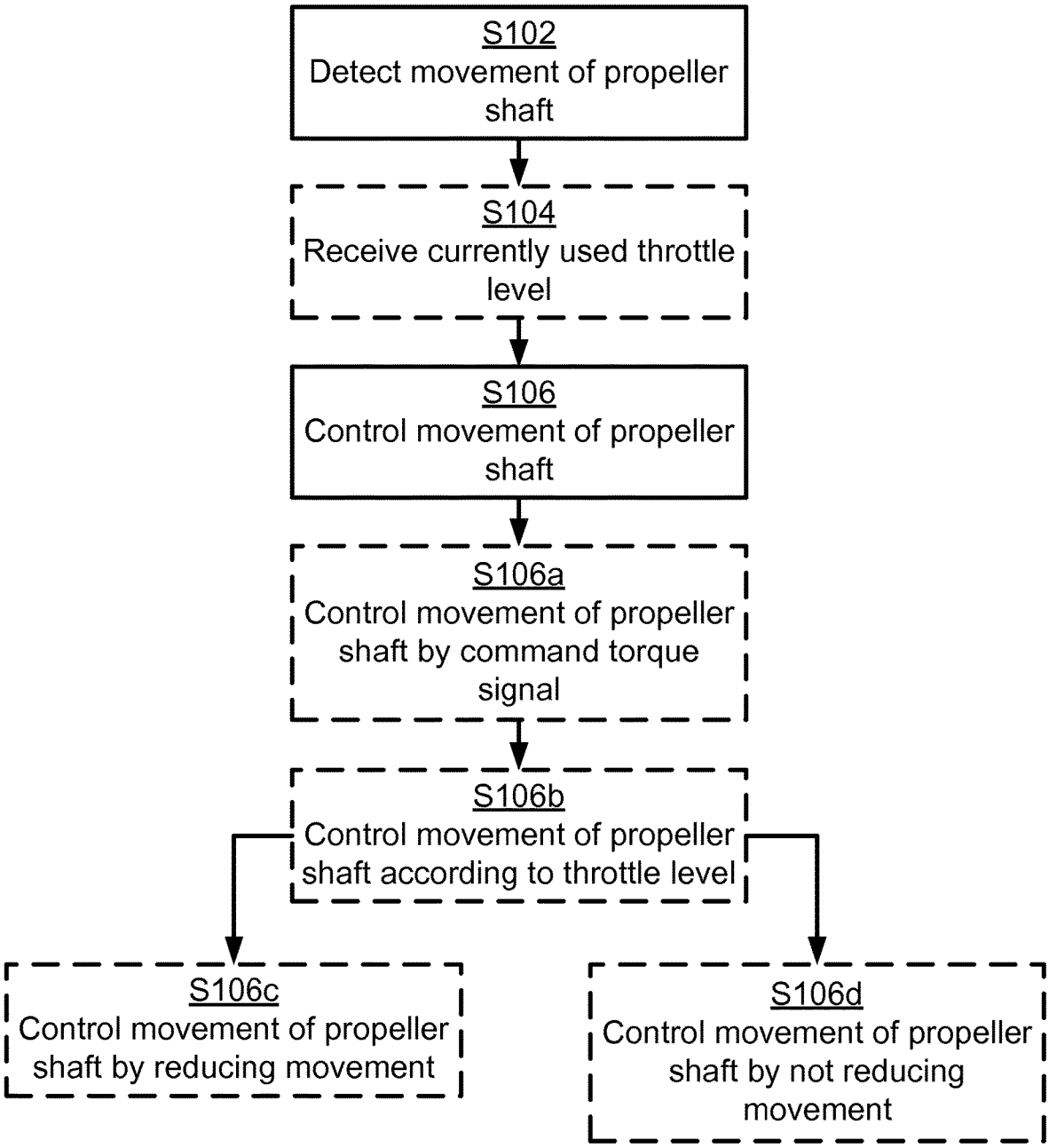
FIGS. 3 and 5 are flowcharts of methods according to embodiments.

FIG. 3 is a flowchart illustrating embodiments of methods for controlling movement of a propeller shaft 8.

The vibration sensor 17, or the controller 200, is configured to, in a step S102, detect movement of the propeller shaft 8 by determining a signature of a sustained oscillation of the propeller shaft 8.

Movement of the propeller shaft 8 could be represented by a measured waveform of the sustained oscillation of the propeller shaft 8. The signature may then be, but is not limited to, the result of correlating a known waveform with the measured waveform of oscillation of the propeller shaft 8. That is, the signature could be determined by correlating a known waveform with the measured waveform. It can also be a set of waveforms. Particularly, the signature could be represented by a set of waveforms, where the set of waveforms comprises quantized waveforms or classified waveforms. The set of waveforms could be quantized by scalar or vector quantization, or classified using logistic regression, or a support vector machine, or a similar method, which set of waveforms is obtained by passing the measured waveform through a bank of filters. That is, the set of waveforms could be determined by passing the measured waveform through a bank of filters. As a further alternative, the signature can be a quantized short-time spectrum of the measured waveform, using, or foregoing the use of windowing. Alternatively, such a spectrum can be expressed as a set of coefficients of an interpolation function or spline that sufficiently well describes such a spectrum. Furthermore, in addition to the signature being considered as a spectrum, it can also be regarded as a set (or vector) of coefficients obtained by convolving the measured waveform with a bank of filter responses, or of wavelets, or Laplacians, or Hessians, or similar. That is, the signature could be represented by a set of coefficients determined by convolving the measured waveform with a bank of filter responses, wavelet coefficients, Laplacian coefficients, or Hessian coefficients. In the above description of the signature, the measured waveform is a time series, indicating movement and oscillation, of measurements forthcoming from the vibration sensor 17, or the controller 200, or the combination of both, obtaining directly, or by proxy, measurement of a physical quantity indicative of oscillation of the propeller shaft 8. In the latter case of measurement by proxy, the proxy method may rely on a plurality of mathematical models of interdependence between direct and proxy measurements. Hence, the controller 200 may thereby detect movement of the propeller shaft 8 and therefrom determine the presence of a signature of a sustained unwanted, parasitic, and/or auto-destructive oscillation of the propeller shaft 8. Embodiments relating to further details of how the movement of the propeller shaft 8 can be detected will be disclosed below.

The propulsion control unit 3, or the controller 200, is configured to, in a step S106, control movement of the propeller shaft 8 according to the determined signature. Hence, the propulsion control unit 3, or the controller 200, may thereby control movement of the propeller shaft 8 according to the determined signature, with the purpose of decreasing the amount of expression of the signature within sensed movement. Embodiments relating to further details of how the movement of the propeller shaft 8 can be controlled will be disclosed below.

The arrangement 100 enables electrical propulsion of the propeller 10 to be designed nearer to criticality, and thereby enables more efficient operation of the propeller 10 at the expense of greater likelihood of cavitation, without actual cavitation occurring.

Embodiments relating to further details of controlling movement of the propeller shaft 8 will now be disclosed.

According to an embodiment the propulsion control unit 3, or the controller 200, is further configured to, in a step S106*a*, control movement of the propeller shaft 8 by forwarding a torque command signal to a drive subsystem 2 of the propeller shaft 8 as a set point. The torque command signal is determined according to the determined signature.

According to an embodiment the propulsion control unit 3, or the controller 200, is further configured to, in a step S104, receive a currently used throttle level for driving the propeller shaft 8. The propulsion control unit 3, or the controller 200, is then further configured to, in a step S106*b*, control movement of the propeller shaft 8 also according to the currently used throttle level.

According to an embodiment the sustained oscillation is caused by a cavitation. The propulsion control unit 3, or the controller 200, can then further be configured to, in a step S106*c*, reduce movement of the propeller shaft 8 upon having determined that the sustained oscillation is caused by the cavitation. However, the propulsion control unit 3, or the controller 200, may be configured to, in a step S106*d*, not reduce movement of the propeller shaft 8 when the currently used throttle level is below a threshold value.

Further details of the above disclosed embodiments for controlling movement of the propeller shaft 8 as well as further embodiments relating thereto will now be disclosed.

The controller 200 comprises a corrective signal generator module. The corrective signal generator module, in turn, comprises a cavitation response former module and an injection signal level setter module provided in series with each other. The corrective signal generator module is configured to provide a cavitation-ameliorating contribution into a plurality of nominal (designed from first principles) signal flows. The plurality of nominal signal flows are any that may be used to provide a command of power, or reference torque, to a drive supplying an electric motor that turns the propeller shaft. This feed-forward treatment can be provided as a lookup table (or higher order spline, or a dynamically evaluated expression on rotation speed of propeller, or through water or other proxy measurement, or a plurality of such measurements combined) that relates ranges of modification of commanded power with respect to surge speed of the vessel.

Figure 4:
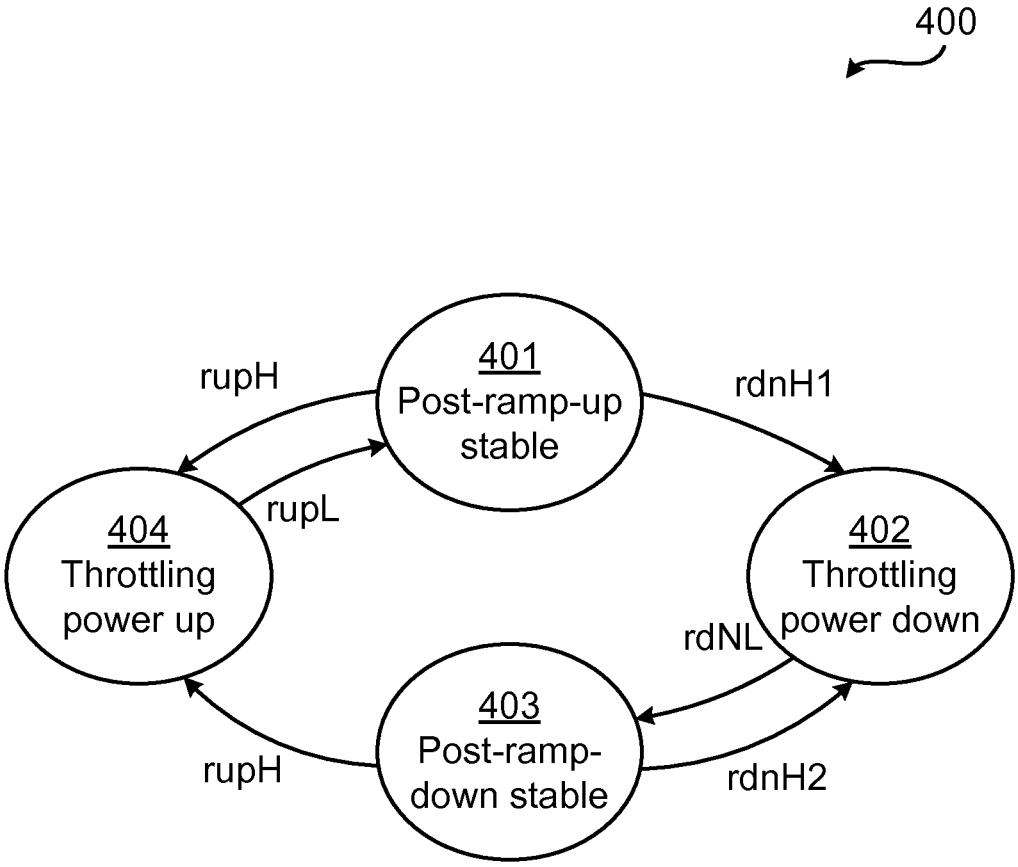
FIG. 4 is a state machine according to an embodiment.

The cavitation response former module further comprises an estimator that identifies periods of cavitation, and a state-machine that dictates the trend increasing, decreasing, or stable, of the ameliorating correction signal, according to the state machine 400 of FIG. 4.

The state machine 400 comprises four states; a post-ramp-up stable state 401, a throttling power down state 402, a post-ramp-down stable state 403, and a throttling power up state 404. Transitions between the states are controlled by the signals rdnH1, rupH, rdnL, rdnH2, rupH, and rupL as described below.

The state machine 400 is implemented to enable the negative offset from the naively commanded power reference to be decreased, i.e. for the controller 200 to match the commanded power reference as closely as possible, preferably exactly, if no cavitation is detected. In such an ideal case, the state machine resides in state 401. Alternatively, in state 401 cavitation may be detected at sporadic moments which do not represent a meaningful feedback. In such cases, the commanded power reference would still be matched exactly. If the intermittence of cavitation detections decreases, i.e. they are detected more often, at some point the state machine transitions along rdnH1 to state 402 where the negative offset will be ordered to steadily increase in absolute value. The state machine is in state 402 until the sporadic nature of cavitation detections decreases back to acceptable levels. At this point the state machine transitions along rdnL to state 403, where the offset is maintained at a steady level. If cavitation detections in state 403 cease to be detected with indicative frequency, and the negative offset is non-null, i.e. the propulsion is not working with nominally commanded power, the state machine transitions along rupH to state 404, where the negative offset's absolute value is opportunistically decreased. In other words, in such a state, state 404, the total commanded creeps back ever closer, and in the limit exactly equal to, the nominally commanded power level. Once this is achieved the state machine transitions along rupL back to the original state 401. Alternatively, it may happen that while the state machine is in state 403, cavitation does not disappear, but continues with unchanged frequency, or increases in frequency of sporadic events, or duration of prolonged events. In such a case, the state machine transitions back along rdnH2 to state 402 so that the command may be offset further below the commanded level.

The injection signal level setter module forms the injection signal, steered by the state output from the state-machine 400, in one of three shapes: increasing or decreasing ramp, or a stable level. Limits on the primary signal flow (e.g. maximum total power rating of the electric podded azimuth thruster (Azipod), etc.) from first principles and installed equipment, are taken into account explicitly.

The estimator inside the cavitation response former module implements hybrid signal processing that obtains a plurality of measurements or estimates, performs signal processing operations on the measurements or estimates, in order to evaluate the degree of quality or expression of the signature of the oscillations, in an embodiment—cavitation, in the measured waveform. Based on the degree of quality, or of expression of the signature in the measurement, and the degree of certitude that the algorithm has in establishing this degree of quality or expression, the algorithm outputs a Boolean estimation (with value true or false) as to whether cavitation is occurring or not at a given period of time. The Boolean output of the estimator is used to steer the state-machine. This state-machine operates on temporal logic, with timers that drive the temporal context of the logic switching. In an example embodiment such timers are realized in terms of a counter composed of a summation point between the new signal and the old counter value passed to the summation point in feedback through a unit delay block.

There are different examples of movements of the propeller shaft indicative of parasitic, auto-destructive, or wearing oscillations, in an embodiment represented by cavitation. According to an embodiment the movement of the propeller shaft 8 is a linear acceleration. This acceleration could be either tangential or axial with respect to the propeller shaft 8. According to an embodiment the movement of the propeller shaft 8 causes a radial and/or axial displacement of the propeller shaft 8.

There are different possible placements of the vibration sensor 17 in relation to the propeller shaft 8. For example, the vibration sensor 17 could be positioned in vicinity of the propeller shaft 8, adjacent the propeller shaft 8, or on the propeller shaft 8.

Figure 5:
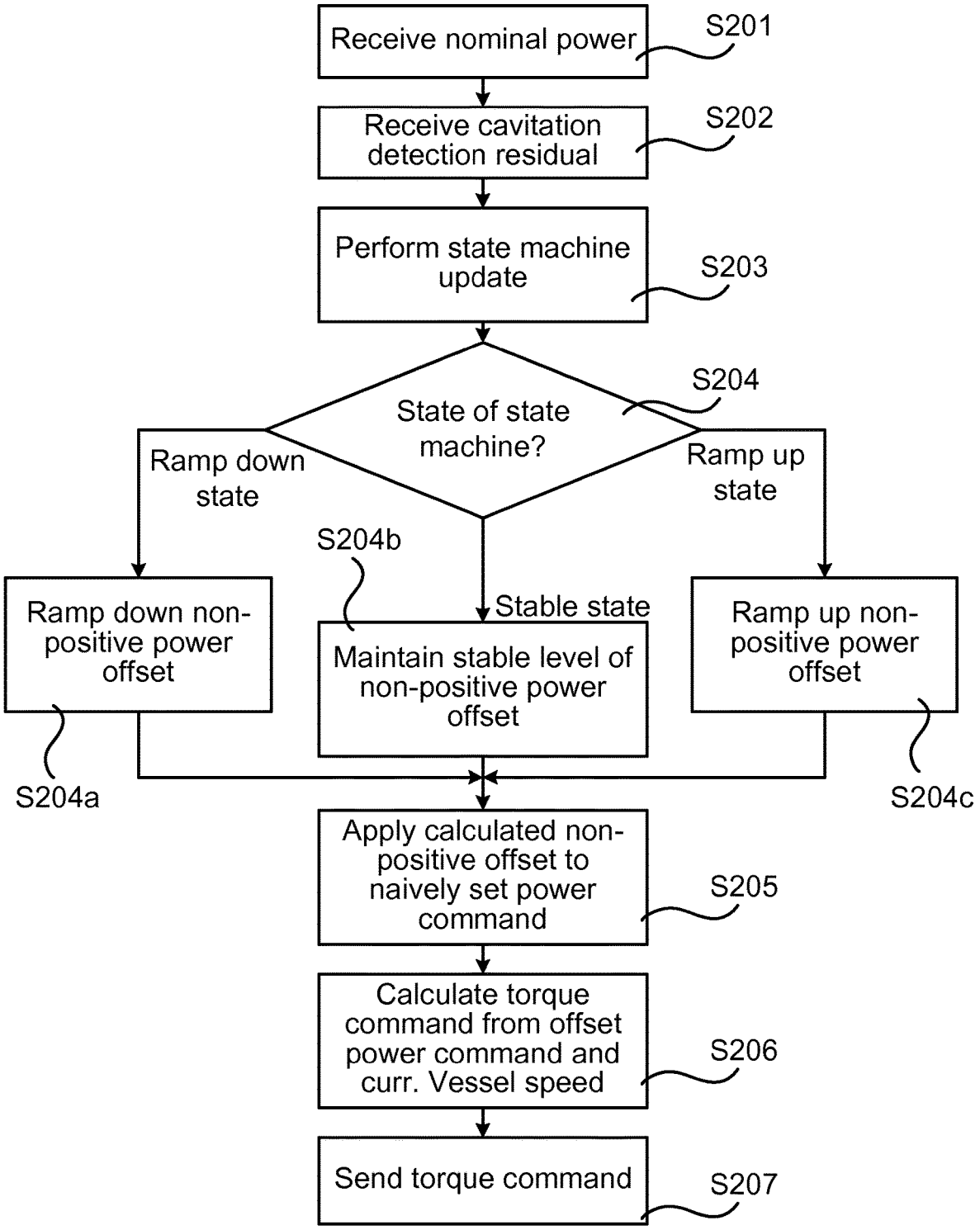
Figure 6:
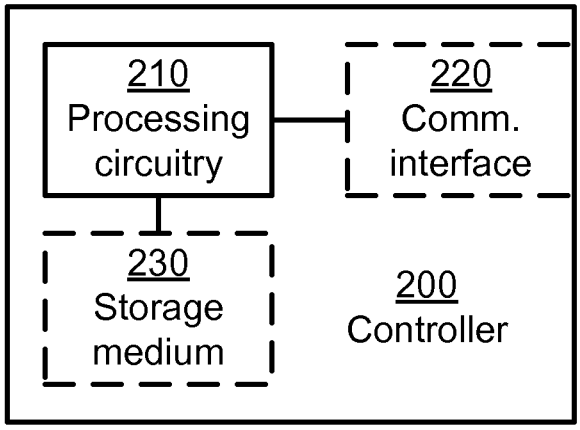
FIG. 6 is a schematic diagram showing functional modules of a controller according to an embodiment.

A particular embodiment for controlling movement of the propeller shaft 8 based on at least some of the above disclosed embodiments will now be disclosed with reference to the flowchart of FIG. 5.

S201: The controller 200 obtains the nominal level of power or torque requested of the main electrical motor's drive.

S202: The controller 200 obtains the cavitation-likelihood specifying residual, and on it performs a hysteresis-facilitated switching of state of detection. An embodiment of how to obtain the cavitation-likelihood specifying residual will be provided below.

S203: The controller 200 runs the temporal logic-based state machine, carrying out, if conditions are fulfilled, switches between states in FIG. 4, or makes sure the current state is continuing to be held.

S204, S204*a*, S204*b*, S204*c*: The controller 200 forms a response on the basis of the state of the state-machine in step S203, by subtracting or adding (ramping down in step S204*a* or ramping up in state S204*c*) a one cycle-time increment, or holding steady (step S204*b*), the current level of the injected non-positive power offset. This calculation saturates at the bottom of 0, and the top corresponding to whatever the current nominal commanded power level as received in step S201 is. The saturation is performed in an anti-windup way.

S205: The controller 200 injects the thus modified, or steady non-positive, offset into the naive commanded power or torque signal flow through a summation point with the commanded power channel, where the offset's channel is negatively prefixed.

S206: The controller 200 determines the command torque to be passed to the drive subsystem as a set point and command based on the modified commanded power and currently achieved angular velocity of the propeller 10.

S207: The controller 200 forwards the determined command torque to the drive subsystem via a field-bus or hardwired signal flow infrastructure.

Operations as defined by step S201-S207 can be performed cyclically to implement and carry out continually the methods described above with reference to the flowchart of FIG. 3. In an embodiment operations as defined by step S201-S207 implements the hysteresis-facilitated mode switching, the state machine, the response former, and the non-positive offset injection, can all be downloaded and run in the propulsion control unit controller, inside the propulsion control unit 3.

A particular embodiment for how to obtain the cavitation-likelihood specifying residual will now be disclosed. This embodiment can be part of above step S202.

S301: The controller 200 receives modified, estimated, filtered, raw, or any combination thereof, of measurements of vibration, at a plurality of physical points, on the mechanical subassembly of the drive-train, terminating with the propeller hub and blades.

S302: The controller 200 detects potential cavitation events by using a plurality of signal processing techniques, machine learning techniques, or a combination thereof to establish, with varying degrees of certitude, the presence or absence, or the triggering quality of expression, of a signature indicative of cavitation in measured movements of the propeller shaft 8.

S303: The controller 200 forms a residual based on the likelihood that the detected potential cavitation events are result of cavitation versus the null hypothesis (i.e., that the detected potential cavitation events are not the result of cavitation), using a plurality of signal processing, model reference, or machine learning techniques, or a combination thereof. The techniques employed are used to determine the degree of conformance between the movements captured by sensor(s) 17 as a plurality of measurements and the representative signature of a cavitation event. Alternatively, the techniques are employed to evaluate the degree of quality, or the degree of expression, of the signature in the captured plurality of measurements, over time.

In an embodiment operations as defined by step S301-S303 implements the detection and identification, and can be be downloaded and run in the propulsion control unit controller, inside the propulsion control unit 3 or a dedicated fast signal processing and machine knowledge unit 20.

FIG. 2*a* schematically illustrates, in terms of a number of functional units, the components of a controller 200 according to an embodiment. Processing circuitry 210 is provided using any combination of one or more of a suitable central processing unit (CPU), multiprocessor, microcontroller, digital signal processor (DSP), etc., capable of executing software instructions stored in a computer program product 710 (as in FIG. 3), e.g. in the form of a storage medium 230. The processing circuitry 210 may further be provided as at least one application specific integrated circuit (ASIC), or field programmable gate array (FPGA).

Particularly, the processing circuitry 210 is configured to cause the controller 200 to perform a set of operations, or steps, S102-S106, S201-S207, S301-S303, as disclosed above. For example, the storage medium 230 may store the set of operations, and the processing circuitry 210 may be configured to retrieve the set of operations from the storage medium 230 to cause the controller 200 to perform the set of operations. The set of operations may be provided as a set of executable instructions.

Thus the processing circuitry 210 is thereby arranged to execute methods as herein disclosed. The storage medium 230 may also comprise persistent storage, which, for example, can be any single one or combination of magnetic memory, optical memory, solid state memory or even remotely mounted memory. The controller 200 may further comprise a communications interface 220 at least configured for communications. As such the communications interface 220 may comprise one or more transmitters and receivers, comprising analogue and digital components. The processing circuitry 210 controls the general operation of the controller 200 e.g. by sending data and control signals to the communications interface 220 and the storage medium 230, by receiving data and reports from the communications interface 220, and by retrieving data and instructions from the storage medium 230. Other components, as well as the related functionality, of the controller 200 are omitted in order not to obscure the concepts presented herein.

Figure 7:
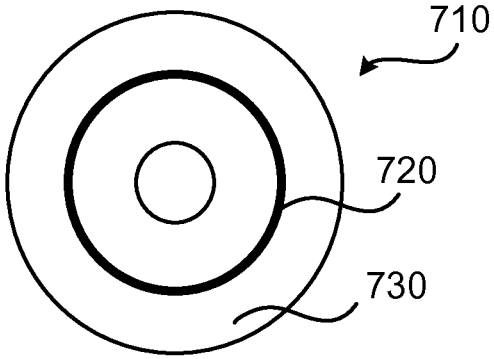
FIG. 7 shows one example of a computer program product comprising computer readable storage medium according to an embodiment.

FIG. 7 shows one example of a computer program product 710 comprising computer readable storage medium 730. On this computer readable storage medium 730, a computer program 720 can be stored, which computer program 720 can cause the processing circuitry 210 and thereto operatively coupled entities and devices, such as the communications interface 220 and the storage medium 230, to execute methods according to embodiments described herein. The computer program 720 and/or computer program product 710 may thus provide means for performing any steps as herein disclosed.

In the example of FIG. 3, the computer program product 710 is illustrated as an optical disc, such as a CD (compact disc) or a DVD (digital versatile disc) or a Blu-Ray disc. The computer program product 710 could also be embodied as a memory, such as a random access memory (RAM), a read-only memory (ROM), an erasable programmable read-only memory (EPROM), or an electrically erasable programmable read-only memory (EEPROM) and more particularly as a non-volatile storage medium of a device in an external memory such as a USB (Universal Serial Bus) memory or a Flash memory, such as a compact Flash memory. Thus, while the computer program 720 is here schematically shown as a track on the depicted optical disk, the computer program 720 can be stored in any way which is suitable for the computer program product 710.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

The invention claimed is:

1. A controller for controlling movement of a propeller shaft on a vessel, the controller comprising processing circuitry, the processing circuitry being configured to cause the controller to:

detect movement of the propeller shaft by determining a signature of a sustained oscillation of the propeller shaft; and control movement of the propeller shaft according to the determined signature;

wherein the processing circuitry is further configured to receive a currently used throttle level for driving the propeller shaft.

2. The controller according to claim 1, wherein the processing circuitry is further configured to control movement of the propeller shaft by forwarding a torque command signal to a drive subsystem of the propeller shaft as a set point, wherein the torque command signal is determined according to the determined signature.

3. The controller according to claim 1, wherein the processing circuitry is further configured to control movement of the propeller shaft also according to the currently used throttle level.

4. The controller according to claim 1, wherein the sustained oscillation is caused by a cavitation.

5. The controller according to claim 1, wherein the processing circuitry is further configured to reduce movement of the propeller shaft upon having determined that the sustained oscillation is caused by a cavitation.

6. The controller according to claim 1, wherein the processing circuitry is further configured to not reduce movement of the propeller shaft when the currently used throttle level is below a threshold value.

7. The controller according to claim 1, wherein movement of the propeller shaft is a linear acceleration.

8. The controller according to claim 7, wherein the acceleration is either tangential or axial with respect to the propeller shaft.

9. The controller according to claim 1, wherein movement of the propeller shaft causes a radial and/or axial displacement of the propeller shaft.

10. The controller according to claim 1, wherein movement of the propeller shaft is represented by a measured waveform of the sustained oscillation of the propeller shaft.

11. The controller according to claim 10, wherein the signature is determined by correlating a known waveform with the measured waveform.

12. The controller according to claim 10, wherein the signature is represented by a set of waveforms, the set of waveforms comprising quantized waveforms or classified waveforms.

13. The controller according to claim 12, wherein the set of waveforms is determined by passing the measured waveform through a bank of filters.

14. The controller according to claim 10, wherein the signature is a quantized short-time spectrum of the measured waveform.

15. The controller according to claim 10, wherein the signature is represented by a set of coefficients determined by convolving the measured waveform with a bank of filter responses, wavelet coefficients, Laplacian coefficients, or Hessian coefficients.

16. An arrangement for controlling movement of a propeller shaft on a vessel, the arrangement comprising:

a controller for controlling movement of the propeller shaft on the vessel, the controller including processing circuitry, the processing circuitry being configured to cause the controller to:

detect movement of the propeller shaft by determining a signature of a sustained oscillation of the propeller shaft; and control movement of the propeller shaft according to the determined signature;

a vibration sensor configured to provide a signal indicative of the sustained oscillation to the controller; and wherein the controller includes a propulsion control unit configured to control movement of the propeller shaft according to the determined signature.

17. The arrangement according to claim 16, wherein the vibration sensor is positioned in vicinity of, adjacent, or on the propeller shaft.

18. An electrical propulsion vessel comprising:

a controller for controlling movement of a propeller shaft on the vessel, the controller including processing circuitry, the processing circuitry being configured to cause the controller to:

detect movement of the propeller shaft by determining a signature of a sustained oscillation of the propeller shaft; and control movement of the propeller shaft according to the determined signature; and a vibration sensor configured to provide a signal indicative of the sustained oscillation to the controller; and wherein the controller includes a propulsion control unit configured to control movement of the propeller shaft according to the determined signature.

19. A method for controlling movement of a propeller shaft on a vessel, the method comprising:

detecting movement of the propeller shaft by determining a signature of a sustained oscillation of the propeller shaft;

controlling movement of the propeller shaft according to the determined signature; and receiving a currently used throttle level for driving the propeller shaft.

20. A computer program for controlling movement of a propeller shaft on a vessel, the computer program comprising computer code which, when run on processing circuitry of a controller, causes the controller to:

detect movement of the propeller shaft by determining a signature of a sustained oscillation of the propeller shaft;

control movement of the propeller shaft according to the determined signature; and receive a currently used throttle level for driving the propeller shaft.

21. A controller for controlling movement of a propeller shaft on a vessel, the controller comprising processing circuitry, the processing circuitry being configured to cause the controller to:

detect movement of the propeller shaft by determining a signature of a sustained oscillation of the propeller shaft; and control movement of the propeller shaft according to the determined signature;

wherein movement of the propeller shaft is represented by a measured waveform of the sustained oscillation of the propeller shaft.

* * * * *